US010309032B2

(12) United States Patent
Crytzer et al.

(10) Patent No.: US 10,309,032 B2
(45) Date of Patent: Jun. 4, 2019

(54) TARGETED HEAT EXCHANGER DEPOSIT REMOVAL BY COMBINED DISSOLUTION AND MECHANICAL REMOVAL

(71) Applicant: WESTINGHOUSE ELECTRIC COMPANY LLC, Cranberry Township, PA (US)

(72) Inventors: Kurtis R. Crytzer, Southport, NC (US); David W. Selfridge, Jr., Greensburg, PA (US); Martin Legoff, Irwin, PA (US); Lauren R. Ikeda, Manchester, CT (US)

(73) Assignee: Westinghouse Electric Company LLC, Cranberry Township, PA (US)

( * ) Notice: Subject to any disclaimer, the term of this patent is extended or adjusted under 35 U.S.C. 154(b) by 0 days.

(21) Appl. No.: 15/078,052

(22) Filed: Mar. 23, 2016

(65) Prior Publication Data

US 2016/0201214 A1 Jul. 14, 2016

Related U.S. Application Data

(62) Division of application No. 14/065,728, filed on Oct. 29, 2013, now Pat. No. 9,334,579.

(51) Int. Cl.

| | |
|---|---|
| ***B24C 1/08*** | (2006.01) |
| ***C25F 1/04*** | (2006.01) |
| ***C25F 1/06*** | (2006.01) |
| ***C25F 3/24*** | (2006.01) |
| ***F28G 9/00*** | (2006.01) |
| ***G21F 9/00*** | (2006.01) |
| ***G21F 9/30*** | (2006.01) |
| ***G21F 9/34*** | (2006.01) |
| ***C23F 14/02*** | (2006.01) |
| ***F22B 37/10*** | (2006.01) |
| ***F28G 13/00*** | (2006.01) |

(52) U.S. Cl.

CPC ..... *C25F 1/04* (2013.01); *B24C 1/086* (2013.01); *C23F 14/02* (2013.01); *C25F 1/06* (2013.01); *C25F 3/24* (2013.01); *F22B 37/10* (2013.01); *F28G 9/00* (2013.01); *F28G 13/00* (2013.01); *G21F 9/004* (2013.01); *G21F 9/30* (2013.01); *G21F 9/34* (2013.01)

(58) Field of Classification Search

CPC ..... C25F 1/06; C25F 3/16–3/24

See application file for complete search history.

(56) References Cited

U.S. PATENT DOCUMENTS

| | | | | |
|---|---|---|---|---|
| 1,430,844 | A * | 10/1922 | Payne | C25F 1/06 205/706 |
| 1,954,473 | A | 4/1934 | Dunn | |
| 3,651,189 | A | 3/1972 | Anderson | |
| 4,376,753 | A | 3/1983 | Lucas | |
| 4,645,581 | A * | 2/1987 | Voggenthaler | C25F 3/16 204/237 |
| 5,423,969 | A | 6/1995 | Masumoto et al. | |
| 5,660,736 | A | 8/1997 | Bizot et al. | |
| 6,740,168 | B2 | 5/2004 | Rootham et al. | |
| 7,344,602 | B2 | 3/2008 | Varrin et al. | |
| 2006/0112972 | A1 * | 6/2006 | Peitersen | C11D 1/345 134/26 |
| 2007/0039815 | A1 | 2/2007 | Bartel | |
| 2008/0277351 | A1 * | 11/2008 | Harman | B01J 20/24 210/691 |
| 2009/0010378 | A1 * | 1/2009 | Haberman | F22B 37/486 376/316 |
| 2012/0055521 | A1 * | 3/2012 | Kim | B08B 3/12 134/184 |
| 2012/0279522 | A1 | 11/2012 | Varrin, Jr. et al. | |
| 2013/0281341 | A1 | 10/2013 | Crytzer et al. | |

FOREIGN PATENT DOCUMENTS

| | | | |
|---|---|---|---|
| EP | 1404489 B1 | | 6/2009 |
| GB | 626239 A | | 7/1949 |
| JP | S58224199 A | | 12/1983 |
| JP | 59162496 A | * | 9/1984 |
| JP | S59162496 A | | 9/1984 |
| JP | 62205293 A | * | 9/1987 |
| JP | S62205293 A | | 9/1987 |
| JP | H10253290 A | | 9/1998 |

(Continued)

OTHER PUBLICATIONS

Nternational Searching Authority, International Search Report and the Written Opinion for International Application No. PCT/US2014/040811, dated Sep. 24, 2014. (Forms PCT/ISA/220, PCT/ISA/210, PCT/ISA237).

(Continued)

*Primary Examiner* — Nicholas A Smith

(74) *Attorney, Agent, or Firm* — Richard J. Coldren; Westinghouse Electric Company LLC

(57) ABSTRACT

This invention relates to compositions and methods for the at least partial dissolution, disruption and/or removal of deposit, such as scale and other deposit, from heat exchanger components. The heat exchanger components can include pressurized water reactor steam generators. In accordance with the invention, elemental metal is added locally to the surface of the deposit and/or anodic or cathodic current is applied locally to the deposit surface to destabilize or weaken the deposit. Subsequently, mechanical stress is applied to the weakened deposit to disrupt and remove the deposit from the surface of the heat exchanger component.

18 Claims, No Drawings

(56) References Cited

FOREIGN PATENT DOCUMENTS

| | | | | |
|---|---|---|---|---|
| JP | 2007304111 | A | 11/2007 | |
| JP | 2012232264 | A | 11/2012 | |
| WO | WO-9739168 | A1 * | 10/1997 | ..... C25F 3/22 |
| WO | 2004104270 | A1 | 12/2004 | |

OTHER PUBLICATIONS

European Patent Office, Extended European Search Report for European Application No. 14857706.7, dated Feb. 28, 2017.
Database WPI, Week 198742, Thomson Scientific, London, GB; AN 1987-294627, XP002767326.
Database WPI, Week 198443, Thomson Scientific, London, GB; AN 1984-266388, XP002767327.

* cited by examiner

TARGETED HEAT EXCHANGER DEPOSIT REMOVAL BY COMBINED DISSOLUTION AND MECHANICAL REMOVAL

CROSS REFERENCE TO RELATED APPLICATION

This application is a divisional application of U.S. Ser. No. 14/065,728, filed on Oct. 29, 2013, entitled TARGETED HEAT EXCHANGER DEPOSIT REMOVAL BY COMBINED DISSOLUTION AND MECHANICAL REMOVAL, and claims priority thereto.

FIELD OF THE INVENTION

The invention generally concerns methods for removal of deposits on components in a nuclear steam supply system and is specifically concerned with disrupting, dissolving, reducing and removing at ambient temperature scale deposit formed on the surfaces of a heat exchanger, in particular, a steam generator.

DESCRIPTION OF RELATED ART

It is typical for metal surfaces which are exposed to water or aqueous solutions over extended periods of time in closed heat transfer systems to develop scale deposits and/or become covered by these said deposits. For example, in commercial nuclear power plants, on-line operation at high temperature can cause shell and tube heat exchangers, such as pressurized water reactor steam generators, to develop adherent scale and/or deposit via deposition or in-situ formation on the metal surfaces of its internal structural parts, such as secondary side surfaces of tubes, tubesheet, and tube support plates. In general, during nuclear power plant operation in a pressurized water reactor, high temperature, radioactive water flows from the reactor core through the inside of the heat exchanger tubes in the steam generator, transferring heat through the walls of the tubing and into the non-radioactive water surrounding the tubes. This causes the non-radioactive water to boil and create the steam that is used for power generation. During the boiling process, scale and other deposits can accumulate on the tubing surfaces, in crevices between the tube support plates, on the tube walls and on horizontal surfaces, such as the tubesheet and the surfaces of tube support plates. The accumulation of the scale and deposits on the internal structural parts of the steam generator over an extended period of time can have adverse impacts on the operational performance and integrity of the steam generators. For example, problems observed at operating nuclear power plants have included inefficient boiling heat transfer, obstruction of cleaning water flow (e.g., during lancing operations), and creation of flow occluded regions resulting in local aggressive corrosive environments impacting the structural integrity of the pressure boundary and structural materials.

Thus, various cleaning methods have been developed to remove the scale and deposit which build-up on the internal surfaces of heat exchangers used to generate steam, such as shell and tube heat exchangers, particularly, pressurized water reactor steam generators, by dissolving and disrupting deposit. Such cleaning methods can include chemical cleaning using a variety of chelating agents at elevated temperature, employing scale conditioning agents at elevated pH levels, and flushing with high pressure water. These processes typically result in a slow deposit removal rate under ambient temperature conditions. Further, the reaction rate is controlled by temperature shifts, pH shifts, or an increase in the concentration of the chelating agent. For instance, steam generator top of tubesheet deposit removal can involve global dissolution and disruption of deposit by utilizing chemical addition, rinsing, sludge lancing with high velocity water or the application of ultrasonic cleaning with a minimal amount of water on the tube-sheet. This process is marginally successful with soft deposits; however, localized regions of hardened deposit are not preferentially removed by these methods. In addition, corrosion penalties to structural materials are incurred because the application is not localized to apply the dissolution process to specific targeted areas.

Effective removal of the deposit from heat transfer components is advantageous for long-term integrity of the radioactive/non-radioactive pressure boundary. It is an objective of the embodiments described herein to provide methods for at least partial dissolution, disruption, reduction and/or removal of deposit, such as scale and other deposit, from heat transfer components, particularly steam generators in pressurized water reactors. It is desirable for the methods to be effective in the absence of elevated temperature and/or effective in elevated pH conditions; for example, at ambient temperature during routine plant refueling outages at an operating nuclear power plant. Furthermore, it is desirable to employ a single step which combines electrochemical and mechanical localized removal technology to at least partially dissolve, disrupt, reduce and/or remove deposit from tubes and/or tube sheets in a steam generator within a routine top of the tubesheet maintenance schedule.

SUMMARY

In one aspect, the invention provides a method for at least partially disrupting or removing deposits formed on a surface of a heat exchanger component in a nuclear water reactor. The method includes performing at least one of adding an effective amount of an elemental metal in solid form and water to a surface of the deposit, and applying an anodic or cathodic current locally to the surface of the deposit. Subsequently, mechanical stress is applied to the surface of the deposit. The method is conducted at ambient temperature.

The deposits can include one or more materials selected from the group consisting of oxide scale and corrosion products.

The elemental metal can be selected from the group consisting of metals with standard electrochemical potentials anodic to low alloy steel. The electrochemical potential of the elemental metal can be more active than the potential of low alloy steel in the galvanic series of metals and alloys. The elemental metal can be selected from the group consisting of zinc, aluminum, magnesium, beryllium, lithium, iron and mixtures thereof. In certain embodiments, the elemental metal can be zinc.

The elemental metal can be in a form selected from the group consisting of slab, granular, powder, colloidal, and combinations thereof The colloidal form can contain particles selected from the group consisting of micron-sized particles, nano-sized particles and combinations thereof.

The method can include adding with the elemental metal and water one or more materials selected from the group consisting of sequestering agent, chelating agent, dispersant, oxidizing agent, reducing agent and mixtures thereof The anodic or cathodic current may be supplied by a working electrode.

The mechanical stress may include hydro-mechanical force or flow. It may also involve a shot blast type delivery to embed the anodic elemental metal into the deposit.

The method can further include disassociating metal ions from the deposits, precipitating the metal ions and removing the precipitate by employing a process selected from the group consisting of filtration and ion exchange.

The method can further include one of purifying the disrupted deposits, transferring said deposits to a containment sump, adding said deposits to a radioactive or nonradioactive waste system and transporting said deposits to a location remote from the steam Generator.

In the method, the elemental metal may be present in a molar equivalent from about 0.01 M to about 2.0 M. The sequestering agent may be selected from the group consisting of acids and salts of orthophosphates, polyphosphates, 1-hydroxyethylidene-1,1-diphosphonic acid, and mixtures thereof. The chelating agent is selected from the group consisting of ethylenediamine tetraacetic acid, hydroxyethyl ethylenediamine triacetic acid, lauryl substituted ethylenediamine tetraacetic acid , polyaspartic acid, oxalic acid, glutamic acid diacetic acid, ethylenediamine-N,N-disuccinic acid, glucortic acid, glucoheptonic acid, N,Ne-ethylenebis-[2-(o-hydroxyphenyl)]-glycine, pyridine dicarboxcylic acid, nitrilotriacetic acid, acids and salts thereof, and mixtures.

The heat exchanger component can be a steam generator in a nuclear steam supply system.

In another aspect, the invention provides a composition effective to at least partially disrupt and dissolve deposits folioed on the shell side surface of a steam generator in a nuclear steam supply system when the composition is in contact with a surface of the deposit when the steam generator is drained below the height of the lowest handhole. The composition includes an aqueous component and an elemental metal component in a solid form. The composition is effective to disassociate at least one metal ion from an oxide lattice of the deposit.

DESCRIPTION OF THE PREFERRED EMBODIMENTS

The invention relates to methods for at least partial dissolution, disruption, reduction and removal of deposit from surfaces, e.g., shell side, of a heat exchanger component. The deposit includes scale, such as oxide scale, particularly, iron oxide scale, that build-up on surfaces of internal structural parts of the heat exchanger component, and corrosion products. In certain embodiments, the surfaces of the heat exchanger component include surfaces, such as the heat exchanger tubing and tube-sheet, in shell and tube heat exchangers in the form of steam generators in a nuclear steam supply system in a nuclear water reactor, such as a pressurized water reactor. The deposit can include contaminants such as aluminum, manganese, magnesium, calcium, nickel, and/or silicon morphologies, as well as deleterious species including copper and lead within the region of the tubesheet secondary side and lower freespan region.

The invention generally includes a combination of electrochemical and mechanical techniques at ambient temperature to at least partially disrupt, dissolve, reduce and remove the oxide scale.

In certain embodiments, a composition is employed which is effective to at least partially disrupt and dissolve deposit formed on a shell side surface of a steam generator in a nuclear steam supply system. The composition is in contact with the surface of the deposit when the steam generator is at least partially drained, e.g., below the height of the lowest handhole. The composition includes an aqueous component and an elemental metal component in solid form. The composition is effective to disassociate at least one metal ion from an oxide lattice of the deposit.

The method includes locally applying, such as to at least one tube or tube-sheet position in the heat exchanger component, an elemental metal in solid form with electrochemical potential anodic to low alloy steel, and in conjunction therewith or following said applying the elemental metal, applying water locally, such as to the at least one tube or tube-sheet. Optionally, the method can also include adding a complexing agent or shifting the pH in order to make the solution chemistry conductive. Addition of the elemental metal is carried out in the absence of elevated temperature, external heat, or plant-applied heat source. The elemental metal, water and optional complexing agent or pH shift are effective to weaken or destabilize the surface or lattice of the deposit. The formation of gas bubbles on the surface of the deposits aids in the disruption of the deposit, which can include impregnating the deposit with the anodic metal in order to optimize the gas formation impact to the structure of the deposit.

The addition of the elemental metal is conducted while the steam generator is drained or partially filed. If the steam generator is drained, the addition can be carried out using a liquid or gaseous delivery method at a range of appropriate flow velocities. If the steam generator is partially filled the elemental metal or may be applied underwater.

The method or the invention also includes applying locally or directly anodic or cathodic current to the deposit on the surface of the heat exchanger component, such as to at least one tube or tube-sheet positioned therein. The anodic or cathodic current can be provided by a working electrode.

Following addition of the elemental metal and/or application of the current to the deposit surface, mechanical stress is applied to disrupt and remove the weakened deposits. Various conventional techniques for applying mechanical stress may be employed, such as but not limited to applying hydro-mechanical force or flow.

The elemental metal is selected from known metals with standard electrochemical potentials anodic to low alloy steel. In certain embodiments, the electrochemical potential of the elemental metal is more active than the potential of low alloy steel in the galvanic series of metals and alloys. Suitable examples of elemental metal for use in the invention include, but are not limited to, zinc, aluminum, magnesium, beryllium, lithium, iron or mixtures thereof. In certain embodiments, the elemental metal is zinc. The elemental metal can be in various solid or particulate form, such as but not limited to, slab, granular, powder, colloidal, and combinations thereof. In certain embodiments, wherein the elemental metal is in colloidal form, it can include micron-sized particles, nano-sized particles and combinations thereof.

The elemental metal is applied locally to the surface of deposit formed on a tube or tubesheet of a heat exchanger component such that the deposit is coated, impinged or impregnated with the elemental metal. In certain embodiments, the heat exchanger component is a steam generator of a nuclear steam supply system.

The elemental metal can be present in varying amounts and the effective amount can depend on the volume of the component and/or associated equipment intended for cleaning. In certain embodiments, the elemental metal concentration can be from about 0.01 M to about 2.0 M based on volume.

Generally, the use of a complexing agent or pH shift is effective to complex ions released from the deposit, e.g., dissociated metal ions. The complexing agent can be selected from a sequestering agent, chelating agent, dispersant and mixtures thereof. Suitable complexing agents can be selected from those known in the art. The sequestering agent can be selected from the group consisting of acids and salts of, orthophosphates, polyphosphates, 1-hydroxyethylidene-1,1-diphosphonic acid, and mixtures thereof. The chelating agent can be selected from the group consisting of ethylenediamine tetraacetic acid, hydroxyethyl ethylenediamine triacetic acid, lauryl substituted ethylenediamine tetraacetic acid, polyaspartic acid, oxalic acid, glutamic acid diacetic acid, ethylenediamine-N,Nr-disuccinic acid, gluconic acid, glucoheptonic acid, N,N'-ethylenebis-[2-(o-hydroxyphenyl)]-glycine, pyridine dicarboxcylic acid, nitrilotriacetic acid, acids and salts thereof, and mixtures thereof The dispersant can be selected from the group consisting of polyacrylic acid, polyacrylamide, polymethacrylate, and mixtures thereof.

The amount of complexing agents employed can vary. In certain embodiments, the sequestering agent, chelating agent, dispersant or combination thereof, can be present in an amount of from about 0.025 weight percent to about 2.5 weight percent based on the composition.

A pH control agent for use in attaining a specific pH can be selected from a variety of those known in the art. In certain embodiments, the following materials can be added to the water in solely or in combination to control pH: ammonium hydroxide, ammonia in equilibrium with ammonium hydroxide, trialkyl ammonium hydroxide, tetramethyl ammonium hydroxide, borates and amines, such as ethanolamine, diethythydroxylamine, dimethylamine, AMP-95, methyoypropylamine, morpholine, and the like.

The anodic or cathodic current applied directly to the deposit formed on the tube or tube-sheet of the heat exchanger component can be in the form of a working electrode. Locally applied current to tube gaps can result in formation of hydrogen gas and the hydrogen gas also can contribute to the mechanical destabilization of the deposit. In certain embodiments, the localized current applied in a solution featuring a sequestering agent is less than 100 mV vs. SCE (standard calomel electrode). The tooling is designed to obtain the current response and may involve adjusting the potential during the process to the appropriate current.

Addition of the elemental metal and/or application of the current to the deposit results in localized destabilization of the surface of the scale lattice. This destabilization initiates reductive dissolution. The reductive dissolution can be conducted under acidic, neutral or alkaline conditions.

In conjunction with or following application of the elemental metal and/or current, e.g., electrochemical potential, mechanical stress, e.g., in the form of hydro-mechanical force or flow stress, may be applied directly to the deposit to disrupt and remove the weakened deposit (which lattice is already electrically unstable). The hydro mechanical stress can be produced using various conventional means known in the art including, but not limited to, water lancing, spraying, laminar or turbulant flow, suction flow, cavitation and combinations thereof. The mechanical stress may also include a shot blast type delivery to embed the anodic elemental metal into the deposit.

In certain embodiments, zinc may interact with magnetite in the deposit to generate gas, e.g., hydrogen and other gases, at or near the surface of the deposit. Without intending to be bound by any particular theory, it is believed that the gas evolution and its subsequent exit can provide mechanical force within the deposit pores resulting in mechanical stress and chemical dissolution.

In certain embodiments, as the anodic elemental contributes electrons into the oxide lattice, gas is generated which applies some level of mechanical stress to the internal surface area of the deposit, in addition, mechanical stress may be applied with water lancing.

In alternate embodiments, the complexing agent can be added in conjunction with the elemental metal or electrochemical potential or in conjunction with the water, or the complexing agent can be added following the addition of the elemental metal or electrochemical potential or following the addition of the water. An oxidizing agent and/or a reducing agent may also be used.

The methods of the invention can be employed at ambient temperature, such as in the absence of system heat or an external heat source being applied to the heat exchanger component. Further, the compositions and methods of the invention can be employed when the liquid contents, e.g., purified water, such as demineralized water, deionized water or mixtures thereof, of the heat exchanger component has a pH in the range of from about 3 to about 14. In certain embodiments wherein the elemental metal is added, the pH is from about 7 to about 14. In other embodiments, wherein the reductive current is applied, the pH is from about 3 to about 6.

In certain embodiments, zinc particulate can be added through mechanical lance at areas where localized deposit accumulation is prevalent. The solution may remain static for a period of time or may be agitated to continuously introduce new, e.g., fresh, sequestering agent or chelating agent and zinc at the deposit surface. The region may then be lanced, hydrolased, ultrasonically treated, or flow may be applied via suction, laminar or turbulant agitation. Sparging with an inert gas is not required for this application. The zinc can be added prior to, in conjunction with, or following the addition of the sequestering or chelating agent.

The methods of the invention combine targeted dissolution technology and mechanical scale disruption technology. Further, the method can be conducted at elevated pH so as to combine electrochemical dissolution, normal solubility principles and mechanical destabilization and removal.

Without intending to be bound by any particular theory, it is believed that the elemental metal releases one or more electrons which is/are accepted by the deposit and as a result of the metal reacting with the deposit, a metal ion is released and a charge imbalance occurs at the deposit surface further destabilizing the deposit lattice. As a result, there is an increased rate of metal ion release. The dissociated metal ion is complexed by the sequestering agent and/or chelating agent. The dissociated metal ion can also be complexed by allowing the dissociated metal ion to precipitate and removing the colloidal precipitate using the dispersant. The precipitate may be removed by employing a conventional process, such as filtration or ion exchange.

For example, in certain embodiments, zinc in a colloidal or particulate form releases one or more electrons accepted by the lattice of an iron oxide scale. The reaction of the zinc with the iron oxide scale in the heat exchanger component destabilizes the scale lattice and causes the release of iron ions from the oxide to form soluble iron. As previously described, the soluble iron is then complexed with the complexing agent, i.e., sequestering agent and/or chelating agent, or allowed to precipitate and then removed with the use of a dispersant.

The method of the invention can further include one of purifying the disrupted deposit, transferring the deposit to a containment sump, adding the deposit to a radioactive or non-radioactive waste system and transporting the deposit to a location remote from the steam aenerator.

While specific embodiments of the invention have been described in detail, it will be appreciated by those skilled in the art that various modifications and alternatives to those details could be developed in light of the overall teachings of the disclosure. Accordingly, the particular embodiments disclosed are meant to be illustrative only and not limiting as to the scope of the invention which is to be given the full breadth of the appended claims and any and all equivalents thereof.

What is claimed is:

1. A targeted, localized method for disrupting or removing at least a portion of deposits formed on a shell-side tube or tube-sheet surface of a steam generator in a nuclear steam supply system, comprising:

a. treating a specific targeted deposit surface of at least one shell-side tube or tube-sheet, comprising:

(i) contacting the specific targeted deposit surface of at least one shell-side tube or tube-sheet with an aqueous composition comprising a molar equivalent of from about 0.01 M to about 2.0 M of elemental metal in solid form, and from about 0.025 weight percent to about 2.5 weight percent of a complexing agent, and/or (ii) applying to the specific targeted deposit surface of the at least one shell-side tube or tube-sheet an anodic or cathodic current; and b. applying to the specific targeted deposit surface of the at least one shell-side tube or tube-sheet hydro-mechanical stress, wherein, the method is conducted at ambient temperature absent of system heat or an external heat source applied to the steam generator, and wherein, the steam generator is at least partially drained below the height of the lowest handhole.

2. The method of claim 1, wherein the deposits comprise one or more materials selected from the group consisting of oxide scale and corrosion products.

3. The method of claim 1, wherein the elemental metal can be selected from the group consisting of metals with standard electrochemical potentials anodic to low alloy steel.

4. The method of claim 3, wherein the electrochemical potential of the elemental metal can be more active than the potential of low alloy steel in the galvanic series of metals and alloys.

5. The method of claim 1, wherein the elemental metal can be selected from the group consisting of zinc, aluminum, magnesium, beryllium, lithium, iron and mixtures thereof.

6. The method of claim 1, wherein the elemental metal is zinc.

7. The method of claim 1, wherein the elemental metal can be in a form selected from the group consisting of slab, granular, powder, colloidal, and combinations thereof.

8. The method of claim 7, wherein the colloidal form can contain particles selected from the group consisting of micron-sized particles, nano-sized particles and combinations thereof.

9. The method of claim 1, wherein the complexing agent is selected from the group consisting of sequestering agent, chelating agent, dispersant, oxidizing agent, reducing agent and mixtures thereof.

10. The method of claim 1, wherein the anodic or cathodic current is supplied by a working electrode.

11. The method of claim 1, further comprising disassociating metal ions from the deposits, precipitating the metal ions and removing resulting precipitate by employing a process selected from the group consisting of filtration and ion exchange.

12. The method of claim 11, further comprising one of purifying disrupted deposits, transferring said deposits to a containment sump, adding said deposits to a radioactive or nonradioactive waste system and transporting said deposits to a location remote from the nuclear water reactor.

13. The method of claim 9, wherein the sequestering agent is selected from the group consisting of acids and salts of orthophosphates, polyphosphates, 1-hydroxyethylidene-1,1-diphosphonic acid, and mixtures thereof.

14. The method of claim 9, wherein the chelating agent is selected from the group consisting of ethylenediamine tetraacetic acid, hydroxyethyl ethylenediamine triacetic acid, lauryl substituted ethylenediamine tetraacetic acid, polyaspartic acid, oxalic acid, glutamic acid diacetic acid, ethylenediamine-N,N'-disuccinic acid, glucosic acid, glucoheptonic acid, N,N'-ethylenebis-[2-(o-hydroxyphenyl)]-glycine, pyridine dicarboxcylic acid, nitrilotriacetic acid, acids and salts thereof, and mixtures.

15. The method of claim 1, wherein the heat exchanger component is a steam generator in a pressurized water reactor.

16. The method of claim 1, wherein the elemental metal is embedded in the deposits and an in-situ formation of gas mechanically disrupts the deposits.

17. A targeted, localized method for disrupting or removing at least a portion of deposits formed on a shell-side tube or tube-sheet surface of a steam generator in a nuclear steam supply system, comprising:

a. treating a specific targeted deposit surface of at least one shell-side tube or tube-sheet, comprising:

(i) contacting the specific targeted deposit surface of at least one shell-side tube or tube-sheet when the steam generator is drained below the height of the lowest handhole with a composition comprising an aqueous component, a molar equivalent of from about 0.01 M to about 2.0 M of elemental metal in solid form, and from about 0.025 weight percent to about 2.5 weight percent of a complexing agent, and/or (ii) applying to the specific targeted deposit surface of the at least one shell-side tube or tube-sheet an anodic or cathodic current less than 100 mV; and b. applying to the specific targeted deposit surface of the at least one shell-side tube or tube-sheet hydro-mechanical stress selected from water lancing, spraying, laminar flow, turbulant flow, suction flow, cavitation and combinations thereof, wherein, the method is conducted at ambient temperature absent of system heat or an external heat source applied to the steam generator.

18. The targeted, localized method of claim 17, wherein the complexing agent is about 2.5 weight percent.

* * * * *